US005265413A

United States Patent [19]

Cannon et al.

[11] Patent Number: 5,265,413

[45] Date of Patent: Nov. 30, 1993

[54] GAS TURBINE COMBUSTION SYSTEM

[75] Inventors: Michael F. Cannon; Brian M. Igoe; Glynn L. Milner; John A. Wood, all of Lincoln, England

[73] Assignee: European Gas Turbines Limited, England

[21] Appl. No.: 859,424

[22] Filed: May 26, 1992

[30] Foreign Application Priority Data

Sep. 28, 1990 [GB] United Kingdom ..... 9021201

[51] Int. Cl.[5] ..... F23R 7/00

[52] U.S. Cl. ..... 60/39.32; 60/39.37

[58] Field of Search ..... 60/39.37, 39.32, 757, 60/759

[56] References Cited

U.S. PATENT DOCUMENTS

| | | | |
|---|---|---|---|
| 2,722,803 | 11/1955 | Travers | 60/39.37 |
| 2,979,898 | 4/1961 | Ward | 60/737 |
| 3,001,366 | 9/1961 | Shutts | 60/39.37 |
| 3,148,918 | 5/1965 | Mulcahey | 60/759 |
| 3,811,274 | 5/1974 | Calderon | 60/39.32 |
| 4,249,372 | 2/1991 | White . | |
| 5,001,896 | 3/1991 | Hilt et al. | 60/39.32 |

FOREIGN PATENT DOCUMENTS 862767 3/1961 United Kingdom .

*Primary Examiner*—Richard A. Bertsch
*Assistant Examiner*—Timothy S. Thorpe
*Attorney, Agent, or Firm*—Kirschstein, Ottinger, Israel & Schiffmiller

[57] ABSTRACT

A tube for interconnecting combustors (11, 12) in a gas turbine combustion system for ignition purposes. The tube comprises three elements: two outer tube sections (15, 17) connected to respective combustors (11, 12) and an inner tube section (16) coupling the two outer sections (15, 17). The ends (20) of the inner tube section (16) protrude somewhat into the outer sections so that air inlet through holes (19) in the outer sections in the vicinity of the two couplings produces cooling air flow (14) adjacent the inner surface of the tube in opposite directions. The bi-directional nature of the air flow (14) substantially prevents any mechanism by which hot combustion gases (10) are carried between the two combustors by the cooling air, thus providing effective tube cooling and prolonging the life of the tube.

3 Claims, 2 Drawing Sheets

GAS TURBINE COMBUSTION SYSTEM

BACKGROUND OF THE INVENTION

1. Field of the Invention

This invention relates to gas turbine combustion systems and in particular to such systems comprising a plurality of combustion chambers, hereinafter referred to as combustors.

2. Description of Related Art

The combustion system in a gas turbine plant commonly comprises a number of combustors arranged in a parallel array in a common air flow, at least some of the combustors being ignited in series. On start-up, one or more of the combustors are ignited and the flame is spread to the other combustors via interconnecting tubes, the pressure difference between the interconnected combustors causing the flame to spread. A typical arrangement is shown in FIG. 1, in which three combustors 1, 2, 3 are interconnected by tubes 4. Normally, of course, there would be more combustors, typically six or eight connected in a closed ring.

One of the life-limiting problems associated with this ignition technique is the damage caused to the tubes, or the combustors to which they are attached, by the flow of hot gases between combustors during normal running after light-up. Successful air cooling of the interconnecting tubes tends to be difficult because cooling air bled into them also has the effect of reducing the cross-lighting performance. It may also cause hot combustion gases to be carried by the air flow between combustors.

Existing designs for the interconnecting tubes depend for their operation on effusion cooling, impingement cooling or film cooling.

Effusion cooling utilises an array of small diameter closely pitched cooling holes spread over the tube wall surface. Each hole bleeds a jet of cooling air through the wall but with very little penetration, so that a cooling barrier is formed. This method tend to be inefficient in its utilisation of air and may give either reduced cross-lighting performance or insufficient cooling.

Impingement cooling involves the use of double skin walls for the tube so that cooling air may be injected through an array of holes in an outer tube to impinge forcibly on an inner tube and so cool it. The cooling air is thus constrained to flow in the gap between the inner and outer tubes. A disadvantage of this method is its mechanical complexity, particularly when applied to small components.

Film cooling, in which a cooling air flow is inlet at one end of the interconnecting tube and directed along and in contact with the inner wall of the tube, tends to induced an 'enjector mechanism' whereby hot gases from one combustor are carried along with the cooling air flow towards the other combustor. This ejector mechanism continues in normal running conditions, i.e. when the pressure difference between the two combustors has been substantially reduced, because the cooling air flow tends to carry hot combustion gases with it, continuously heating up the tube upstream of the air entry point with detrimental effect. The result is that the interconnecting tubes become cracked or burnt and need regular replacement.

SUMMARY OF THE INVENTION

It is an object of the present invention to provide a gas turbine combustion system in which the aforementioned problems of the known designs are alleviated.

According to the invention there is provided a gas turbine combustion system comprising a plurality of combustors, the combustors being interconnected by tube means adapted to pass a flame from an ignited combustor to another combustor, wherein the tube means is adapted to receive air injected at one or more points of entry intermediate its ends and to cause such air to move in opposite directions towards the respective combustors, the form of the tube means at the or each point of entry being such that air is substantially constrained to flow along the inner surface of the tube means to provide cooling of the tube means when operation of the system is established.

The tube means may comprise an annular duct section having an outer wall and a point of entry in the outer wall, the duct section being open to the tube means to provide said constrained air. Preferably, the tube means comprises two annular duct sections, each point of entry providing access to one of the duct sections.

In a preferred embodiment of the invention, the tube means comprises a central tube and two end tubes which overlap the central tube, each annular duct section being formed between the central tube and an overlapping end of one of the end tubes, said points of entry comprising for each end tube a plurality of holes formed through and spaced around the wall of the end tube at the overlapping end. Preferably, in the vicinity of the overlap, each end tube is so shaped that the point of entry directs air towards an end of the tube means.

Preferably, the coupling between the central tube and at least one of the end tubes at the overlap is such as to allow for thermal expansion of the tube means.

The invention also embraces tube means adapted for use in a gas turbine combustion system as aforesaid.

A gas turbine combustion system in accordance with the invention will now be described, by way of example only, with reference to the accompanying drawings, in which:

DETAILED DESCRIPTION OF THE PREFERRED EMBODIMENT

Figure 1:
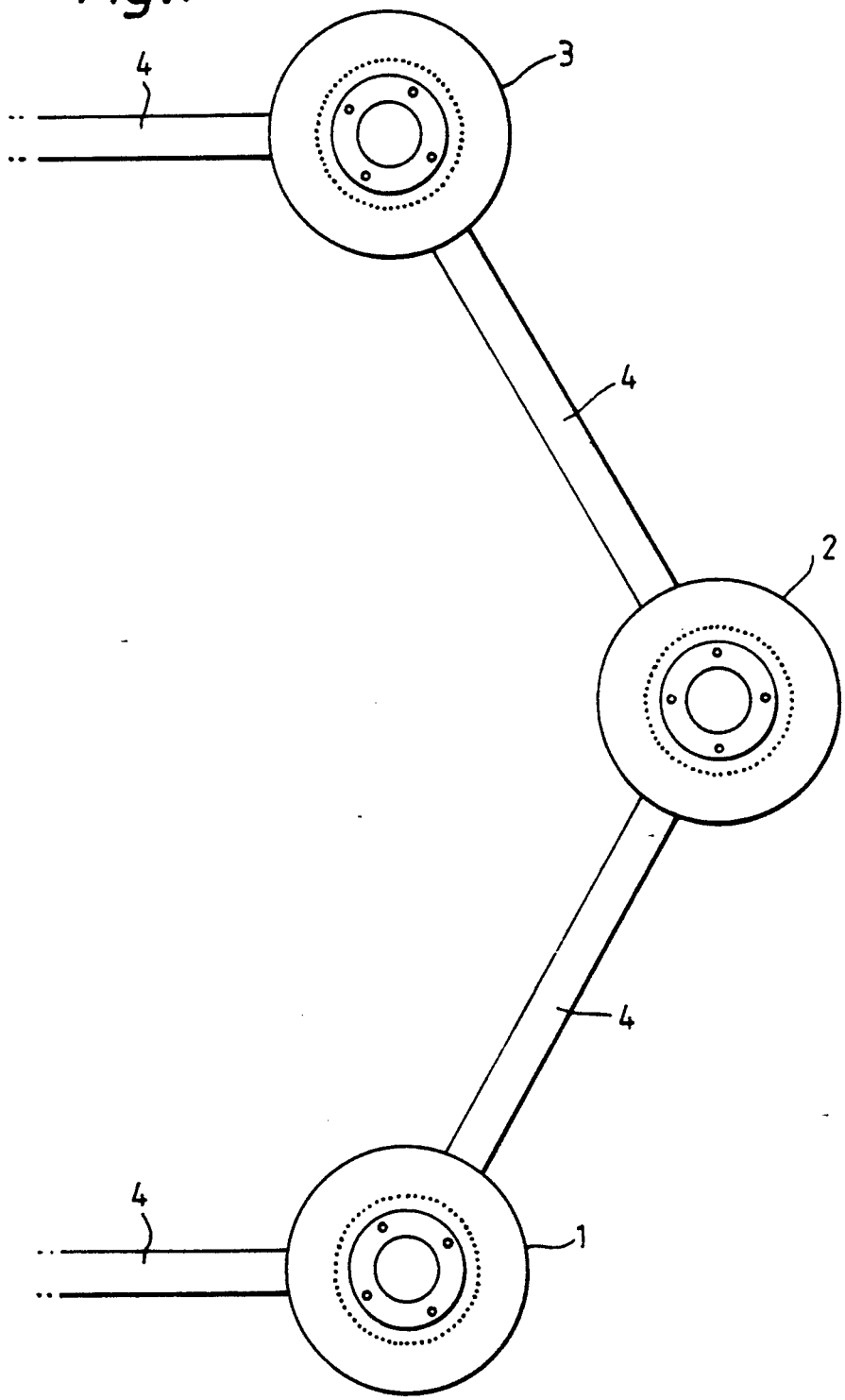
FIG. 1, referred to above, shows three combustors of a number making up a typical gas turbine combustion system according to the prior art.

Referring to the drawings, FIG. 1 shows a typical multi-combustor system having combustors 1, 2 and 3 and tubes 4 interconnecting them and other combustors not shown. It should be understood that by "tube" is meant a duct which may be of circular, rectilinear, or other cross-section. Initial ignition might be arranged to take place in combustor 2 with the flame then spreading to combustors 1 and 3 via the tubes 4, and thence to the other combustors not shown.

Figure 2:
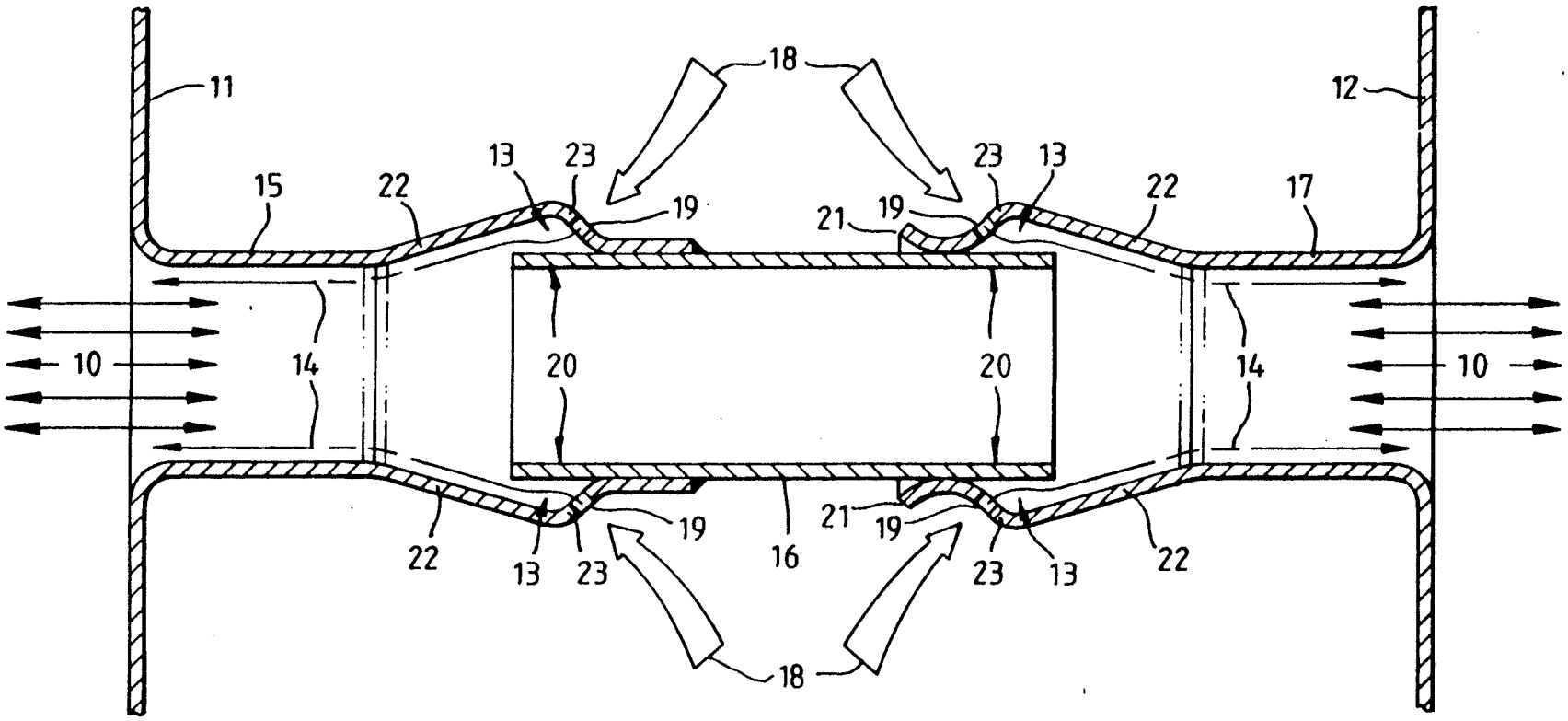
FIG. 2 shows, in a sectional view, detail of part of a gas turbine combustion system in accordance with the invention.

FIG. 2 shows detail of an assembled interconnecting tube arrangement for two combustors in a system in accordance with the invention. The arrangement comprises a central tube 16 and two end tubes 15 and 17.

The end tubes 15 and 17 are coupled respectively to combustors 11 and 12 (part shown) in a system of the general type shown in FIG. 1. The connection between the end of each end tube and the central tube is such as to provide an overlap forming an annular duct section 13. The end tubes 15, 17 are so shaped that cooling air 18, inlet into the duct 13 through a plurality of holes 19 in each of the end tubes, is substantially constrained to flow along the inner surface of the tubes towards the combustors 11 and 12, as indicated by the arrows 14. This film of cooling air 18, which would generally be bled from the compressor of the turbine, serves to protect the tubes 15 and 17 from flame heat when operation of the system has been established. The bi-directional nature of the air flow 14 serves to prevent any mechanism occurring which might allow flow 10 of hot primary combustion gases between the two combustors 11 and 12 under normal running conditions, i.e. once all the combustors have been ignited.

As shown in FIG. 2, by way of example only, each of the end tubes 15, 17 comprises a divergent wall section 22, i.e. divergent in width in a direction towards the central tube 16, followed by a convergent wall section 23. The convergent section 23 and a part of the divergent section 22 overlap the end of the central tube 16. The air inlet holes 19 are provided spaced around the circumference of each of the end tubes 15, 17 at the convergent section. It can be seen that the holes 19 represent points of entry for injected air which provide access to the duct section 13 in a direction having a component towards the combustor end of the end tube. The central tube 16 has a cylindrical form with a diameter substantially the same as that of the end tubes at their narrowest point. The overlap where the ends of the central tube protrude within the end tubes defines the annular duct section 13, the protruding portion 20 of the central tube serving to direct the air flow 18 along the inner surface of the tubes 15, 17, as indicated by the arrows 14. It can be seen that, at the overlap, the central tube 16 and the end tube 15 or 17 are so shaped that the annular duct section 13 provides a passageway for injected air which directs air towards the combustor end of the end tube.

The central tube 16 may be fixed securely to either end tube 15 or 17, or it may be held in position by such means that it is free to move, within limits, with respect to both end tubes. It will be appreciated that it is also necessary that the fit between the central tube and at least one of the end tubes be sufficient to allow for assembly of the parts and also for differential movement of the parts due to the thermal expansion. For this reason it may be useful for the end tube 17 which accepts the central tube to have a curved entry shape, as indicated, for example, by reference 21 on FIG. 2. The other end tube 15 may be welded to the central tube as shown.

Although in the embodiment of the invention described with reference to FIG. 2, the interconnecting tube arrangement between the two combustors comprises three tubes, it will be appreciated that the invention is not so limited. Other suitable tube arrangements will occur to those skilled in the art, which meet the requirement that air inlet at one or more points intermediate the two interconnected combustors flows in opposite directions towards the two combustors, the air flow being substantially constrained to flow along the inner surface of the tube arrangement. For example, in one such alternative embodiment (not illustrated), the two end tubes in the FIG. 2 arrangement are contiguous, the central tube being disposed coaxially within the main tube to define an annular duct section intermediate the combustor ends of the main tube. One or more inlet holes in the main tube provide points of entry for cooling air at a substantially central axial position of the inner tube.

We claim:

1. A gas turbine combustion system, comprising:

(A) a plurality of combustors; and (B) tube means extending along a length and interconnecting said combustors for passing a flame from an ignited combustor to another combustor, said tube means including:

(a) a single-wall central tube having opposite ends, (b) two single-wall end tubes which respectively overlap said ends of said central tube to form an annular duct at each end only of said central tube, said overlap being a minor proportion of the length of said tube means, (c) said end tubes having apertures for providing entry for air to said annular ducts, and (d) each said annular duct having a closed inner end so that air entering from said apertures is directed along a path toward the respective combustor, said directed air being initially constrained by the respective annular duct and then constrained for the major part of its path to the respective combustor by the wall of the respective end tube only, thereby cooling the respective end tube.

2. A system according to claim 1, wherein, in the vicinity of the overlap, each end tube has shaped sections for directing the entering air toward the respective combustor.

3. A system according to claim 1, wherein the central tube and at least one of the end tubes at the overlap are mounted to allow for thermal expansion of the tube means.

* * * * *